US006095390A

United States Patent [19]

Bogle

[11] Patent Number: 6,095,390

[45] Date of Patent: Aug. 1, 2000

[54] ATHLETIC BALL-CARRYING POUCH AND WAIST BELT

[76] Inventor: Anthony O. Bogle, 354 W. Dayton Cir., Fort Lauderdale, Fla. 33312-1809

[21] Appl. No.: 09/141,081

[22] Filed: Aug. 27, 1998

[51] Int. Cl.[7] ..... A45F 3/00

[52] U.S. Cl. ..... 224/664; 224/919; 224/682; 224/683; 224/268; 206/315.9

[58] Field of Search ..... 224/663, 664, 224/919, 683, 682, 268; 206/315.9; 383/907; D3/257, 221

[56] References Cited

U.S. PATENT DOCUMENTS

| | | | |
|---|---|---|---|
| D. 373,472 | 9/1996 | Eaton et al. | D3/257 |
| 1,927,492 | 9/1933 | Halpin | 206/315.9 |
| 4,510,982 | 4/1985 | Sangroni | 224/919 |
| 4,810,102 | 3/1989 | Norton | 224/578 |
| 5,085,320 | 2/1992 | Scott | 206/315.9 |

*Primary Examiner*—Linda J. Sholl
*Attorney, Agent, or Firm*—David P. Lhota, Esq.; Bowen & Lhota, P.A.

[57] ABSTRACT

An athletic ball carrying pouch and belt for holding and transporting any lightweight ball, such as, a basketball, soccer ball or volleyball, to the park, playground or gym, comprising a plurality of panels attached together to form a first hemisphere and a second hemisphere and an accessible volume therein, a releasable fastener attached to said first and second hemispheres for providing and denying access to the volume and an adjustable belt for securing the pouch around a person's waist while the wearer is walking, jogging, running or riding a bicycle, moped or motorcycle.

19 Claims, 2 Drawing Sheets

10
1
19
26a
20
20a
20b
11
14a
14b
36
17
24
22
32
34
18
13a
40
13b
28
12

ATHLETIC BALL-CARRYING POUCH AND WAIST BELT

CROSS REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

This invention relates generally to an athletic ball carrying pouch and belt, and more particularly, to a combination carrying pouch and belt adapted for holding and transporting any lightweight ball, such as, a basketball, soccer ball or volleyball, on the waist while the wearer is walking, jogging, running or riding a bicycle, moped or motorcycle to the park, playground or other venue of play.

2. Description of the Background Art

Carrying a basketball, soccer ball or volleyball to the park, playground, gym or other venue of play along with keys, money, beverages or other possessions can be cumbersome and awkward. In fact, it can be dangerous if the person is riding a bicycle, motorcycle or moped. When the player has to hold the ball with one hand it limits their ability to control the vehicle, thus increasing the risk of an accident. It would be much more convenient to strap the ball to the player's body. However, there is no device known which is adapted for strapping and transporting a ball around one's waist. Such a device would be well received by the frequent sports participant. It would allow him to conveniently and safely carry the ball to and from the park, gym or playing field. In addition, it can provide a place for storing the player's keys, money or other personal items while they play.

A carrying pouch for basketballs, soccer balls and/or volleyballs would also be well received by the corporate market. Corporate sponsorship is becoming more common place at sporting events. Corporations frequently set up booths or tables at sporting or sports related events and give away gifts to its visitors. A pouch that can be used for strapping a ball to one's waist would provide an appreciated gift and a perfect medium for displaying the corporation's trademark and/or logo.

Various types of waist packs and athletic bags are known. However, none of these address or solve the above noted needs. For instance, waist packs are commonly used for storing keys, money and identification around the waist. Waist packs, however, are not large enough or tailored for receiving and carrying a basketball, soccer ball or volleyball. Their only structure and purpose is for carrying personal articles. Known athletic bags also fail to provide structure for strapping a ball around a person's waist. While some athletic bags may have sufficient volume for receiving the ball, they do not have a dedicated strap for attachment to the waist. In addition, the size and shape of known athletic bags are cumbersome and not specifically tailored to the size and shape of the athletic ball.

As the background art fails to teach or contemplate an athletic ball-carrying pouch for holding, strapping and transporting a ball around a person's back, there exist a need for such a pouch. The instant invention fulfills this need.

BRIEF SUMMARY OF THE INVENTION

In light of the foregoing void in the background art, it is an object of the instant invention to provide an athletic ball pouch that is adapted for receiving and carrying a basketball, soccer ball or volleyball around a person's waist.

It is also an object of the instant invention to provide an athletic ball pouch that is specifically adapted for receiving and carrying a basketball around a person's waist.

Another object of the instant invention is to provide an athletic waist pouch for a ball that frees up the wearer's arms and hands for carrying other articles or operating a bicycle, motorcycle, moped or other form of transportation.

An additional object of the instant invention is to provide an athletic waist pouch that is simple and cost effective to manufacture.

A further object of the instant invention is to provide an athletic ball pouch that enhances the safety of its wearer while traveling to the park, playground or gym.

It is still another object of the instant invention to provide an athletic ball pouch that has optional accessories for holding keys, money, pagers, phones and/or other personal articles.

In light of these and other objects, the instant invention in the preferred embodiment provides an athletic ball pouch for carrying a basketball around a person's waist. The athletic ball pouch generally comprises a fabric housing having a volume slightly larger than a light weight athletic ball, such as a basketball, soccer ball or volleyball, and an adjustable belt that can draw the ball towards the lumbar section of the wearer's back. The pouch comprises a plurality of flexible panels preferably stitched together along common edges such that the pouch would substantially define a spherical volume if inflated. For purposes of clarity, the pouch has essentially two states. A first state where it is flaccid and not holding a ball, and a filled state where the ball fills the volume of the pouch. With respect to basketballs, the filled pouch has a volume that is slightly larger than the basketball's displacement volume so that it easily and conveniently receives the ball while adequately securing it therein. Although the discussion herein is primarily directed to a pouch for receiving and carrying a basketball the instant invention may be adapted for accommodating other athletic balls, such as volleyballs or soccer balls, without departing from the scope and spirit of the instant invention.

The pouch defines an opening for receiving the ball into the pouch volume. The opening is preferably centrally located proximal to the pouches equatorial axis along contiguous panel side edges. However, the opening may be located and defined at another section of the pouch without departing from the scope and spirit of the instant invention. The opening is sealed closed by a fastening system. The fasteners employed preferably comprise a zipper. In alternative embodiments, other fasteners may be employed. For instance, opposing corresponding hook-and-loop strips, strap and buckle fasteners, snaps, buttons or other known fasteners may be employed. The preferred embodiments of the instant invention may use either hook-and-loop strips or a zipper at the opening. These types of fasteners provide the quickest and most convenient structure for opening and closing the ball opening.

The instant invention further comprises a strap or belt attached to at least one panel of the pouch. The strap may be elastic or otherwise. The strap includes a fastener system for securing the pouch around a person's waist. The fastener system may comprise a slider and side release buckle or corresponding hook-and-loop patches proximal the straps free ends. The strap and panels are preferably waterproof and non-absorbent. The invention may also include additional pockets and accessories for holding items such as a pager, phone, keys and/or money.

DETAILED DESCRIPTION OF THE INVENTION

Figures 1, 3, 7:
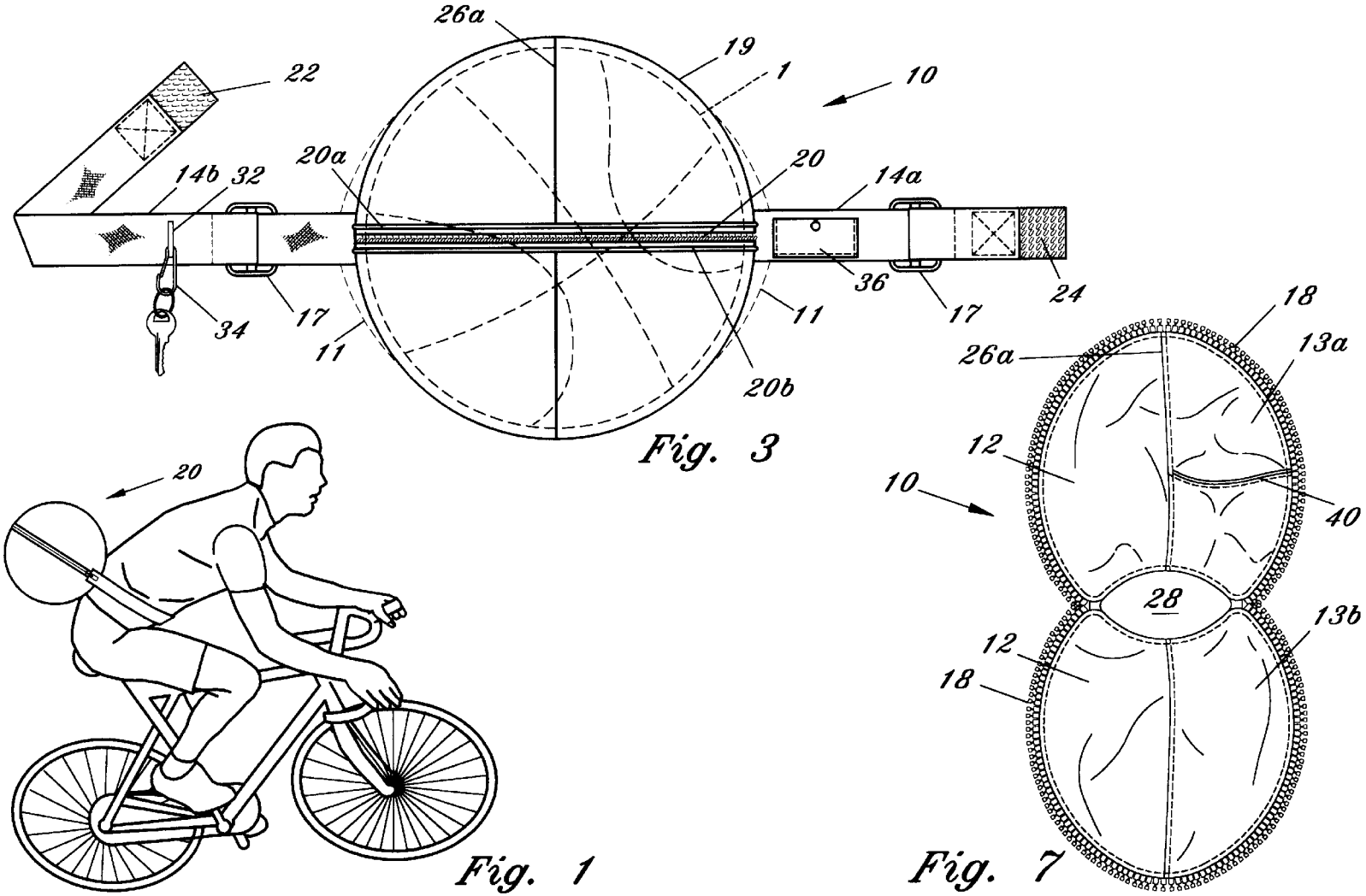
FIG. 1 is an illustration of the preferred embodiment of the athletic carrying pouch of the instant invention as used by an individual to carry and transport a basketball.
FIG. 3 is a side elevational view of the preferred embodiment of the athletic carrying pouch of the instant invention illustrating a ball in the pouch.
FIG. 7 is a front view of the pouch opened, illustrating the interior pouch and the preferred positioning of the pouch prior to inserting a ball.

With reference to the drawings, FIGS. 1–7 depict the preferred embodiments of the athletic ball carrying pouch of the instant invention which is generally characterized by the numeric character 10. The ball pouch 10 generally comprises a flexible, collapsible, fabric housing 11 having a volume slightly larger than a light weight athletic ball 1, such as a basketball, soccer ball or volleyball, and an adjustable belt 14 that can draw the ball 1 towards the lumbar section of the wearer's back. The housing 11 comprises a plurality of side panels, 26 or 30, and a bottom panel sewn together to define an inner volume and a strap or belt 14 for mounting to a person's body. With reference to FIG. 1, the ball pouch 10 is tailored for wearing around the waist and has an inner volume that conveniently and snugly receives a basketball. However, the ball pouch 10 may vary in size to accommodate different size balls without departing from the scope and spirit of the instant invention. The design of the instant invention allows one to strap a basketball, soccer ball, volleyball or other ball, to one's back as they travel to the park, playground, gym or other venue for play. The benefits of the instant invention are especially realized when the wearer is simultaneously riding a bicycle and holding a basketball, as shown in FIG. 1.

The ball pouch 10 comprises a housing 11 that substantially takes the shape of the ball 1 stored. A conventional basketball is approximately 9.55 inches in diameter. Volleyballs and soccer balls are slightly smaller. The housing has a maximum diameter and volume that is larger than the basketball and thus larger than similar balls, such as volleyballs and soccer balls. The housing 11 maintains spacing 19 around the ball 1 by employing additional material. The spacing may vary around the ball. For instance, the housing 11 may have additional material approximately ninety degrees from the bottom panel, as shown in FIG. 3, or more completely around the equatorial section. The additional material may also be uniformly distributed throughout the housing 11. The housing 11 comprises a plurality of flexible panels, 26 or 30, joined to a bottom panel 28 to form a collapsible housing 11 and volume. The panels, 26–30, are flexible and sized for adapting to the size and shape of the ball received in the pouch volume while maintaining desired spacing. As seen in FIG. 3, the volume defined by the pouch 10 is slightly larger than the ball being stored. Approximately a quarter of an inch to an inch clearance 19 is available between the surface of the ball 1 and the panels of pouch. Accordingly, if the pouch 10 were inflated it would have a diameter that is half an inch to two inches larger than the diameter of the ball along predetermined locations. In the preferred embodiment, the diameter of an inflated pouch volume is approximately one inch larger than the ball. These clearances may vary without departing from the scope and spirit of the invention and may vary at certain locations around the surface area of ball. For instance, the material may be drawn up tight to the ball at predetermined locations.

Figure 2:
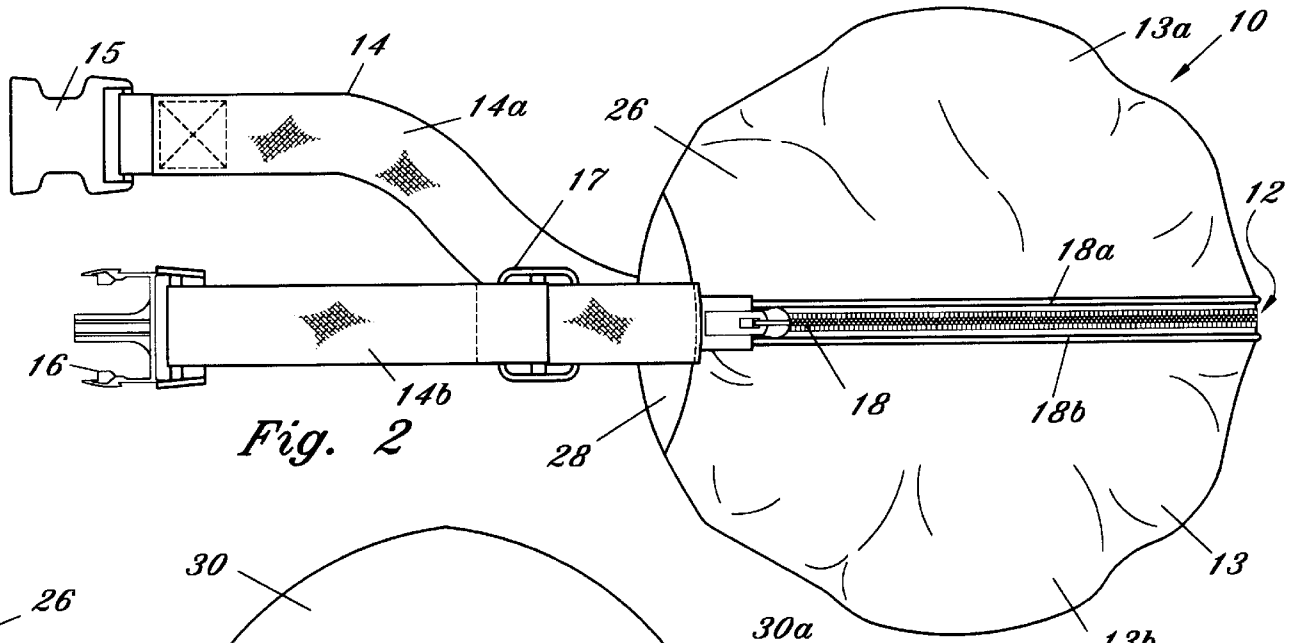
FIG. 2 is a side elevational view of the preferred embodiment of the athletic carrying pouch of the instant invention prior to inserting a ball into the pouch.
Figure 4:
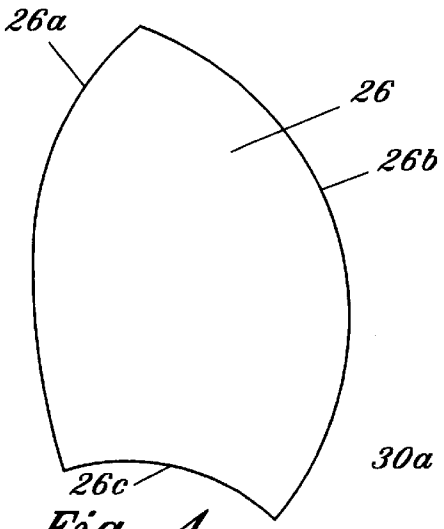
FIG. 4 is a front elevational view of a quarter panel, or quarter panel pattern, used in making the preferred embodiment of the athletic carrying pouch of the instant invention.

With reference to FIG. 4, a quarter panel 26 is shown. In the preferred embodiment, the pouch 10 employs four (4) quarter panels 26 and a bottom panel 28, as shown in FIGS. 1, 2, 4 and 6. The bottom panel 28 is substantially circular. The quarter panels 26 have opposite convex side edges, 26*a* and 26*b*, which meet at a common vertex and a concave bottom edge 26*d* opposite the vertex. Side edges 26*b* comprise upper edges and side edges 26*a* comprise equatorial edges. In order to provide a substantially spherically adapted pouch 10, the side edges 26*a* and 26*b* are substantially symmetrical but may vary in curvature. For instance, the upper side edge 26*b* may have a smaller radius of curvature than the equatorial side edges 26*a*, as shown in FIG. 4. The quarter panel edges are stitched together in two sets so as to define a first hemisphere 13*a* and a second hemisphere 13*b*. Each hemisphere section 13*a*, 13*b* comprises two panels 26 stitched together along their upper side edges 26*b*. The equatorial side edges 26*a* define the pouch's opening 12. The peripheral edge of the bottom panel 28 is stitched to the quarter panel's concave edges 26*c* and joins the first and second hemispheres together, as shown in FIGS. 1 and 2.

Figure 5:
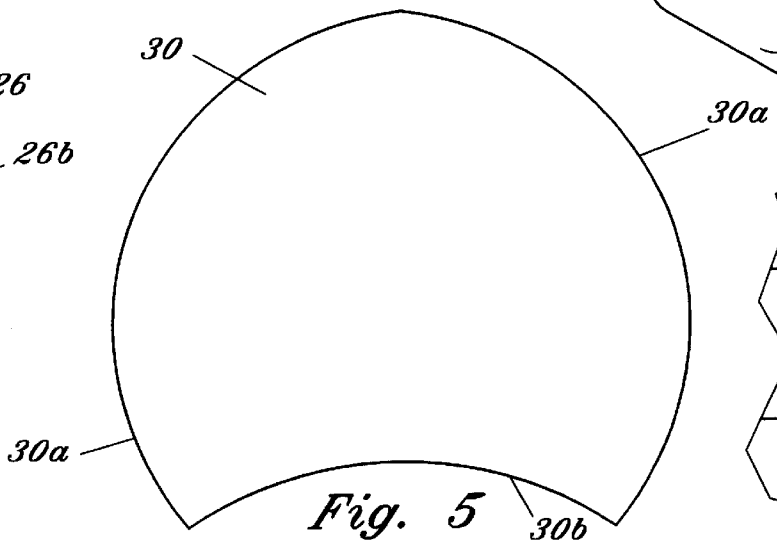
FIG. 5 is a front elevational view of a half panel, or half panel pattern, used in making an alternative embodiment of the athletic carrying pouch of the instant invention.
Figure 6:
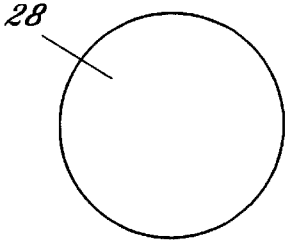
FIG. 6 is a front elevational view of a bottom panel, or bottom panel pattern, used in making the various embodiments of the athletic carrying pouch of the instant invention.

In an alternative embodiment, the ball pouch 10 may employ two half panels 30, instead of four quarter panels 26, as shown in FIG. 5. The half panel is substantially symmetrical and approximately twice the size of the quarter panels. The half panel 30 has two oppositely disposed convex edges 30*a* and a concave bottom edge 30*b*. The radius of curvature for the side edges 30*a* coincides with the equatorial side edges in the preferred embodiment for defining the opening 12.

The panels 26–30 preferably comprise nylon or canvas based material, such as magnalite nylon and/or WMR coated nylon for enhanced durability and water resistance. A nylon or similar material also facilitates the heat stamping, printing or photographic imaging transfer of images such as company logos, names or other indicia. It is preferred that the material employed for the panels are non-absorbant. In alternative embodiments, the panels 26–30 may comprise an elastic material for enhanced adaptability to the ball being stored. The panels 26–30 may also comprise a mesh material so as to decrease the amount of material actually used. However, a more uniform material is required to facilitate the placement of a company logo or other indicia.

The equatorial edges of the first and second hemisphere's 13*a*, 13*b* define the pouch opening 12. The pouch opening 12 is opened and closed by a fastening system. The preferred fastening system may comprise either a zipper system 18 or a hook-and-loop system 20. The zipper system 18 has a first zipper strip 18*a* stitched to the first hemisphere section 11 and a corresponding second zipper strip 18*b* stitched to the second hemisphere section 13, as shown in FIG. 2. The first and second zipper strips 18*a*, 18*b* are stitched to their respective hemisphere sections 13*a*, 13*b* along quarter panel edges 26*a*, also referred to herein as the equatorial edges. The first and second zipper strips 18*a*, 18*b* are preferably permanently joined at the ends so as to prevent the zipper latch from sliding off the zipper teeth. The zipper 18 is approximately twenty-eight (28) inches long and is attached approximately 1.5 inches above the bottom panel 28. The zipper 18 is preferably anchored or spaced from the bottom panel 28 by a tab section 38 at each end of the zipper. The tab section 38 also provides a securing mechanism which is held to secure the pouch at a point in substantial alignment with the zipper when the zipper is being opened or closed. The length and exact point of zipper attachment may vary without departing from the scope and spirit of the invention.

The hook-and-loop system 20 comprises a hook strip 20*a* and a loop strip 20*b*. One strip is stitched to the first hemisphere equatorial edge and the other strip is stitched to the second hemisphere equatorial edge. The hook strip 20*a* and loop strip 20*b* may be stitched to either hemisphere section 13*a*, 13*b* so long as they cooperate to open and close the pouch opening 12, as shown in FIG. 3.

Figure 2A:
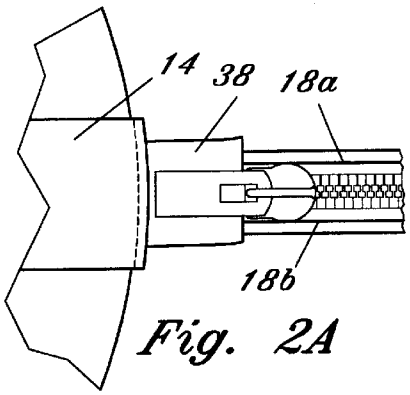
FIG. 2A is an enlarged view of the zipper attachment area.

With reference to FIGS. 2, 2A and 3, the ball pouch 10 further comprises an adjustable strap 14 attached to at lease one panel. The strap 14 is preferably made from polypro webbing. The strap 14 may also comprise an elastic material. The preferred method of attaching is stitching, but other attaching techniques may be employed without departing from the scope and spirit of the instant invention. The strap 14 comprises a first section 14*a* and a second section 14*b*. Each section 14*a*, 14*b* may comprise individual components stitched to at least one panel such that the strap sections 14*a*, 14*b* cooperate to wrap around a person's waist. Alternatively, the strap sections 14*a*, 14*b* may comprise a unitary component stitched to at least one panel at a predetermined location in the mid-section between the strap ends. In the preferred embodiment, the strap's first section 14*a* and second section 14*b* are individual components which are attached proximal to the seam defined by the bottom panel 28 and the quarter panels' concave edges 26*c*. The first and second sections 14*a* and 14*b* are preferably attached approximately 180 degrees apart with respect to the bottom panel 28 to provide support and leverage at more than one point. It should be noted, however, that the strap 14 and/or strap sections 14*a*, 14*b* may be attached at other locations on the pouch 10 so long as adequate support and leverage are achieved.

The first strap section 14*a* is preferably twenty (20) to thirty (30) inches long and approximately one and a half (1.5) inches wide. A length of approximately twenty-nine (29) inches has been found to work well. The second strap section 14*b* is referenced as the stationary section and is preferably fifteen (15) to twenty (20) inches long and one and a half (1.5) inches wide. A length of approximately eighteen (18) inches has been found to work well. These dimensions may vary without departing from the scope and spirit of the invention. Each strap section 14*a,b* has a fixed end attached to the pouch as discussed above, and a free end to which a strap fastener system is secured. The first and second strap sections 14*a,b* are preferably adjustable in length by the adjusting rings 17. To tighten or loosen the strap 14, a strap section is pulled through the ring 17, on either or both strap sections 14*a,b*. The ball may be pulled up tighter against the lumbar region of the back by tightening the straps 14*a,b*.

The preferred strap fastener system comprises a 1.5 inch Delrin slider (female section) 15 attached to one strap free end and a corresponding 1.5 inch Delrin side release buckle (male section) 16 attached to the other strap free end, as shown in FIG. 2. The slider 15 and side release buckle 16 may be attached to either strap 14*a*, 14*b*. In an alternative embodiment, the strap fastener system may comprise corresponding hook-and-loop fasteners 22, 24, as shown in FIG. 3. For instance, a hook patch 22 may be stitched or adhered to an inside surface of the stationary belt 14*b* near the free end and a corresponding loop patch 24 may be stitched or adhered to an outer surface of the first strap 14*a*. In other embodiments, the fastening system may comprise snaps, buttons, or a conventional belt buckle system.

In another embodiment of the instant invention, the ball pouch 10 may include extra loops and/or pockets on the strap 14 and/or panels for storing other items, such as money, keys and jewelry. For instance, a loop 32 and/or latch 34 may be incorporated into the design for holding keys, as seen in FIG. 3. A separate pocket 36 may be stitched or adhered to the strap 14, or panels, for storing items such as money, keys, jewelry or other items. Alternatively, a pocket 40 may be stitched to the inside surface of the pouch 10, as seen in FIG. 7. The instant invention may also include indicia 50 on the outside surface of the housing 11 displaying a company logo, team logo, phrase or other marking.

To use the instant invention, the opening fastener 18 or 20 is opened to expose the pouch volume through the opening 12, as shown in FIG. 7. The ball 1 is inserted through the opening 12. Once the ball 1 is in place, the fastener 18 or 20 is closed. If the fastener comprises a zipper 18, then the tab section 38 is held with one hand while the other hand pulls the zipper 18 shut. The pouch 10 is then positioned on the lower part of the back as the straps are pulled around the waist. To secure the pouch 10 and straps 14, the strap fasteners 15–16 or 22–24 are connected. When using the slider 15 and side release buckle 16, the buckle 16 is inserted into the slider 15. To release the strap 14, the side release buckle 16 is pressed inward from the sides to release the buckle 16 from the slider 15. If the hook-and-loop fasteners 22, 24 are used then the hook fastener 22 is aligned with the loop fastener 24 and engaged therewith. If the pouch 10 is loose or tight, the straps 14 may be adjusted by pulling them through the adjusting rings 17.

With respect to other embodiments, it should be noted that the shape, number and size of the panels may vary to achieve the objects of the instant invention. The instant invention is preferably adapted for basketballs, but may vary in size for other balls.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. An athletic ball pouch for carrying a sports ball around a person's waist, said pouch comprising:

a flexible, collapsible, substantially spherically constructed housing comprising a plurality of panels attached together to define an accessible volume, said panels comprising shapes and sizes that are attached together in a way that substantially adapts to the size and shape of a basketball, said panels comprising at least two flexible side panels each having opposing convex side edges which join at a common vertex and a concave bottom edge, said side panels being attached together at selected side edges to form a curved structure and an open substantially circular bottom end, and a substantially circular bottom panel corresponding to and attached to said substantially circular bottom end;

said volume being larger than the volume of the ball;

an opening defined by said housing for inserting and removing a ball into and from said volume;

fastener means for opening and closing said opening for selectively providing and denying access to said volume;

at least one strap attached to at least one panel of said plurality of panels and having two free ends for wrapping around the person's waist; and securing means, attached to said strap proximal said free ends, for cooperatively joining said free ends to secure the pouch to the person's body when said strap is wrapped around the person's waist.

2. A pouch as recited in claim 1, wherein said side panels form a first hemisphere and a second hemisphere, said first and second hemispheres defining said opening, said fastener means being attached to said first hemisphere and said second hemisphere.

3. A pouch as recited in claim 2, wherein said fastener means comprises:

a zipper having a first strip attached to said first hemisphere and a second strip attached to said second hemisphere.

4. A pouch as recited in claim 1, wherein said housing comprises:

four flexible quarter panels and a flexible bottom panel, said quarter panels being selectively attached to each other and to said bottom panel to form said housing, said quarter panels defining said opening.

5. A pouch as recited in claim 4, wherein said fastener means is attached to said four quarter panels so as to releasably join and disjoin said four quarter panels when denying and providing, respectively, access to said volume.

6. A pouch as recited in claim 5, wherein said securing means comprises:

a male adapter attached to said first section; and a female adapter attached to said second section, said male and female adapters having corresponding structure for releasably interlocking together.

7. A pouch as recited in claim 1, wherein said strap comprises:

a first section attached to said bottom panel;

a second section attached to said bottom panel at a substantially opposite point from where said first section is attached, said first section and said second section each defining one of said two free ends which are selectively joined together by said securing means.

8. An athletic ball pouch for carrying a sports ball substantially the size of a basketball around a person's waist, said pouch comprising:

a flexible, collapsible, substantially spherically constructed housing comprising a first collapsible hemisphere and a second collapsible hemisphere attached together to define an accessible volume, said first and second hemispheres each comprising at lease two flexible side panels having opposing convex side edges which join at a common vertex and a concave bottom edge, said side panels being attached together at selected side edges to form a curved structure;

a substantially circular bottom panel corresponding to and attached to said side panels at said concave bottom edge of each panel, said bottom panel holding said first and second hemispheres when opening and closing said opening;

said volume being larger than the volume of the ball;

an opening defined by and between said first hemisphere and said second hemisphere for inserting and removing a ball into and from said volume;

a fastener means, attached to said first hemisphere and said second hemisphere, for opening and closing said opening to selectively provide and deny access to said volume;

at least one strap attached to said housing and having two free ends for wrapping around the person's waist; and securing means, attached to said strap proximal said free ends, for cooperatively joining said free ends to secure the pouch to the person's body when said strap is wrapped around the person's waist.

9. A pouch as recited in claim 8, wherein said fastener means comprises:

a zipper having a first strip attached to said first hemisphere and a second strip attached to said second hemisphere.

10. A pouch as recited in claim 8, wherein said strap comprises:

a first section attached to said bottom panel; and a second section attached to said bottom panel at a substantially opposite point from where said first section is attached, said first section and said second section each defining one of said two free ends which are selectively joined together by said securing means; said strap being adjustable in length.

11. A pouch as recited in claim 10, wherein said securing means comprises:

a male adapter attached to said first section; and a female adapter attached to said second section, said male and female adapters having corresponding structure for releasably interlocking together.

12. An athletic ball pouch for carrying a lightweight ball substantially the size of a basketball around a person's waist, said pouch comprising:

a flexible, collapsible, substantially spherically constructed housing comprising at least two flexible side panels wherein each of said side panels comprise opposing convex side edges which join at a common vertex and a concave bottom edge, said side panels being attached together at selected side edges to form a curved structure and an open substantially circular bottom end, said side panels forming a first collapsible hemisphere and a second collapsible hemisphere attached together to define an accessible volume, said first and second hemispheres being attached to a bottom panel, said bottom panel being substantially circular and attached to said substantially circular bottom end;

said volume being larger than the volume of the ball;

an opening defined by and between said first hemisphere and said second hemisphere for inserting and removing a ball into and from said volume;

fastener means, attached to said first hemisphere and said second hemisphere, for opening and closing said opening to selectively provide and deny access to said volume;

at least one strap attached to said housing and having two free ends for wrapping around the person's waist; and securing means, attached to said strap proximal said free ends, for cooperatively joining said free ends to secure the pouch to the person's body when said strap is wrapped around the person's waist.

13. A pouch as recited in claim 12, wherein said fastener means comprises:

a zipper having a first strip attached to said first hemisphere and a second strip attached to said second hemisphere.

14. A pouch as recited in claim 12, wherein said strap comprises:

a first section attached to said bottom panel; and a second section attached to said bottom panel at a substantially opposite point from where said first section is attached, said first section and said second section each defining one of said two free ends which are releasably joined together by said securing means; said strap being adjustable in length.

15. A pouch as recited in claim 12, wherein said housing comprises:

at least four side panels attached to said bottom panel, at least two of said panels being attached at common side edges and comprising said first hemisphere and at least two of said panels attached at common side edges and comprising said second hemisphere.

16. A pouch as recited in claim 12, further comprising:

at least one pocket attached to said pouch for storing items, such as money; and means, attached to said pouch, for clipping a set of keys.

17. A pouch as recited in claim 12, wherein said fastener means comprises:

a first hook-and-loop strip attached to said first hemisphere; and a second corresponding hook-and-loop strip attached to said second hemisphere, wherein said first and second strips mate when engaged with each other.

18. A pouch as recited in claim 12, wherein said securing means comprises:

a first hook-and-loop strip attached to said first section of said strap; and a second hook-and-loop strip attached to said second section of said strap wherein said first and second strips mate when engaged.

19. A pouch as recited in claim 12, further comprising:

an indicia means, fixed to an exterior surface of said housing, for displaying a predetermined message.

* * * * *